US011332854B2

(12) United States Patent
Koeckritz et al.

(10) Patent No.: US 11,332,854 B2
(45) Date of Patent: May 17, 2022

(54) CLOTHING AND METHOD FOR PRODUCING A CLOTHING

(71) Applicant: VOITH PATENT GMBH, Heidenheim (DE)

(72) Inventors: Uwe Koeckritz, Heidenheim (DE); Juergen Abraham, Nattheim (DE); Wan Zeti Zafina Wan Ahmad Nathri, Perakdarul Ridzuan (MY)

(73) Assignee: Voith Patent GmbH, Heidenheim (DE)

( * ) Notice: Subject to any disclaimer, the term of this patent is extended or adjusted under 35 U.S.C. 154(b) by 862 days.

(21) Appl. No.: 14/905,379

(22) PCT Filed: Jul. 17, 2014

(86) PCT No.: PCT/EP2014/065383
§ 371 (c)(1),
(2) Date: Jan. 15, 2016

(87) PCT Pub. No.: WO2015/007844
PCT Pub. Date: Jan. 22, 2015

(65) Prior Publication Data

US 2016/0160404 A1 Jun. 9, 2016

(30) Foreign Application Priority Data

Jul. 17, 2013 (DE) ..... 102013214033.9

(51) Int. Cl.
*D03D 1/00* (2006.01)
*D21F 1/00* (2006.01)
*D03D 3/04* (2006.01)

(52) U.S. Cl.
CPC ..... *D03D 1/0094* (2013.01); *D03D 3/04* (2013.01); *D21F 1/0027* (2013.01); *D21F 1/0054* (2013.01)

(58) Field of Classification Search
CPC .. D21F 1/0054; D21F 1/0027; Y10S 162/904; Y10S 162/902; Y10S 162/903;
(Continued)

(56) References Cited

U.S. PATENT DOCUMENTS 4,784,190 A * 11/1988 Mullaney ..... D21F 1/0045 139/383 A
5,888,915 A * 3/1999 Denton ..... D02G 3/447 139/383 A
(Continued)

FOREIGN PATENT DOCUMENTS

DE 1930556 A1 12/1970
DE 19540229 C1 12/1996
(Continued)

*Primary Examiner* — Vincent Tatesure
(74) *Attorney, Agent, or Firm* — Laurence A. Greenberg; Werner H. Stemer; Ralph E. Locher

(57) ABSTRACT

A clothing, in particular a drying wire, for a machine for producing a fibrous web, such as a paper or cardboard web, is a planar textile structure from yarns which intersect in a machine direction and in a cross-machine direction. The planar structure has two edges oriented in the machine direction and two edges oriented in the cross-machine direction. The clothing is joinable along the edges oriented in the cross-machine direction in the machine so as to form an endless belt. The clothing is only calendered by introducing energy in peripheral regions which extend along the edges oriented in the machine direction and/or along the edges oriented in the machine cross direction, on account of which in the peripheral regions the MD yarns are welded to the CMD yarns, and the thickness and/or permeability of the clothing are/is reduced.

19 Claims, 1 Drawing Sheet

(58) Field of Classification Search
CPC .... D03D 1/0094; D03D 2700/02; D03D 3/04; D03D 2700/03
USPC ..... 139/373 AA, 387 R, 388; 162/903, 902, 162/289–375; 28/141, 142; 428/57–62, 428/102–104, 193; 474/267
See application file for complete search history.

(56) References Cited

U.S. PATENT DOCUMENTS

| | | | | |
|---|---|---|---|---|
| 8,172,986 | B2 * | 5/2012 | Bella | D21F 1/0054 156/462 |
| 8,784,615 | B2 | 7/2014 | Straub et al. | |
| 2004/0154148 | A1 * | 8/2004 | Nilsson | D21G 1/00 28/165 |
| 2007/0028997 | A1 | 2/2007 | Best et al. | |
| 2010/0024178 | A1 | 2/2010 | Hansen et al. | |
| 2012/0040150 | A1 | 2/2012 | Manninen | |
| 2012/0244313 | A1 | 9/2012 | Stone et al. | |
| 2013/0034680 | A1 | 2/2013 | Manninen | |
| 2014/0053376 | A1 | 2/2014 | Manninen | |
| 2014/0199510 | A1 | 7/2014 | Manninen | |
| 2015/0247280 | A1 | 9/2015 | Manninen | |

FOREIGN PATENT DOCUMENTS

| | | | |
|---|---|---|---|
| DE | 102011002498 | A1 | 7/2012 |
| EP | 1749924 | A1 | 2/2007 |
| EP | 2055831 | A1 | 5/2009 |
| WO | 2010121360 | A1 | 10/2010 |
| WO | 2011069258 | A1 | 6/2011 |
| WO | 2011127594 | A1 | 10/2011 |
| WO | 2013023272 | A1 | 2/2013 |
| WO | 2013086609 | A1 | 6/2013 |
| WO | 2014075170 | A1 | 5/2014 |

* cited by examiner

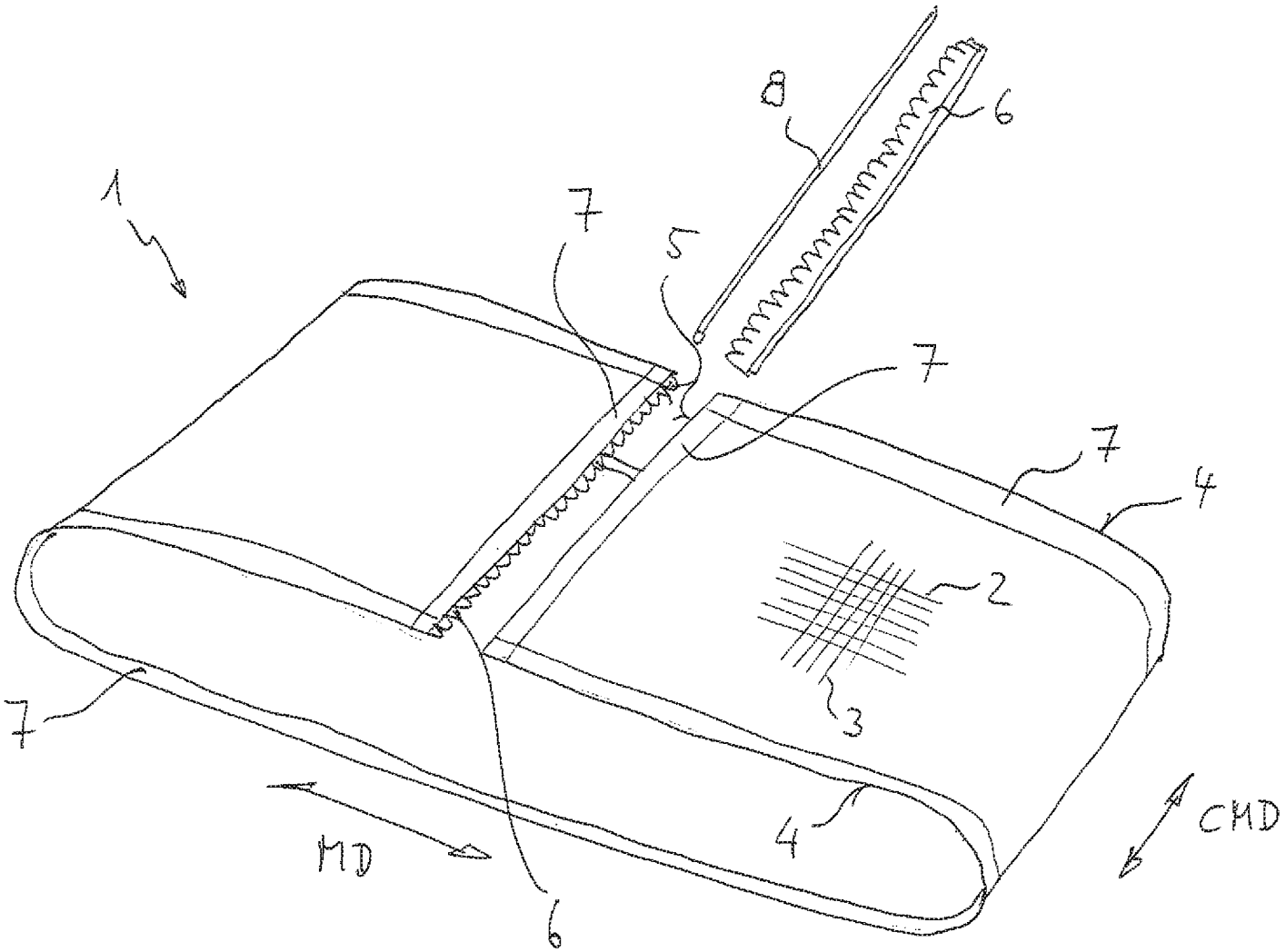
CMD
MD
1
2
3
4
5
6
7
8

CLOTHING AND METHOD FOR PRODUCING A CLOTHING

BACKGROUND OF THE INVENTION

Field of the Invention

The invention proceeds from a clothing for use in a machine for producing a fibrous web, such as a paper or cardboard web. The clothing comprises or is formed from a planar textile structure from yarns which intersect in a substantially perpendicular manner and which are oriented so as to be substantially in a machine direction (MD) and in a cross-machine direction (CMD), wherein the planar structure has two edges oriented in the machine direction (MD) and two edges oriented in the cross-machine direction (CMD), and wherein the clothing, by means of seam elements which on the edges that are oriented in the cross-machine direction (CMD) are formed by or are connected in a releasable or non-releasable manner to the yarns which are oriented in the machine direction, is joinable in the machine so as to form an endless belt. The clothing is in particular a drying wire for use in the drying section of a machine for producing a fibrous web. The invention furthermore relates to the production of such a clothing.

In a paper machine or cardboard machine, clothings are to be found at various positions and fulfill various tasks which inter alia comprise guiding and supporting the fibrous web and dewatering the latter. Initial dewatering is handled by forming wires in the forming section; in the pressing section the fibrous web is guided on press felts through roller gaps, so as to further extract water contained in the fibrous web; and in the drying section conveying through the machine and further drying of the fibrous web is performed while being facilitated by a drying wire.

Drying wires are usually configured in the form of planar textile structures which are either composed of plastic helices which are mutually interleaved and interconnected by pintles. Alternative forms thereof are woven fabrics, made from yarns which intersect in a substantially perpendicular manner and which may be interwoven in various patterns.

It is in particular disadvantageous in known drying wires that the edges thereof, on account of the production process, have the tendency to fray and as a result, for yarns to protrude in the course of the service life, the planar textile structure unraveling.

BRIEF SUMMARY OF THE INVENTION

It is thus an object of the invention to state a clothing which is producible in a simple and cost-effective manner and mitigates or avoids the disadvantages of the prior art in that the edges are treated such that fraying is no longer possible.

The object in terms of the clothing is achieved by the claimed features and in terms of the method for producing a clothing of this type as claimed.

It is provided here according to the invention that the planar textile structure is only calendered by introducing energy in peripheral regions which extend along the edges oriented in the machine direction and/or along the edges oriented in the machine cross direction, on account of which in the peripheral regions the MD yarns at least partially and/or in portions are welded to the CMD yarns and/or at the intersection points thereof are interconnected in a form-fitting manner, and the thickness and/or permeability of the clothing are/is reduced.

On account thereof, a very simple and very effective type of edge reinforcement which dispenses with complex coatings and changes in terms of materials and/or weaving patterns may be achieved.

According to the method according to the invention for producing a clothing it is provided that the method comprises the following method steps: i) providing a planar textile structure; ii) cutting the planar structure along a predefined cutting line in the machine direction and/or in the cross-machine direction; iii) fusing ends of the yarns oriented in the machine direction and/or fusing of the yarns oriented in the cross-machine direction with the yarns oriented in the machine direction, so as to configure a smooth cutting edge.

This has the advantage that all work required for tailoring the planar structure may be completed at one working station and in only one processing pass, without the drying wire, which is usually very long and on account of the yarn counts heavy and hard to handle, having to be moved to other processing stations, for example.

Further advantageous aspects and embodiments of the invention are derived from the dependent claims.

It may preferably be provided that in the calendered peripheral regions the MD yarns are fused with the CMD yarns so as to be integral therewith, at least partially or in portions.

According to one advantageous aspect of the invention, post-perforation may be performed for matching the permeability of the calendered peripheral regions with the permeability of the planar structure outside the calendered peripheral region. Preferably, the at least one calendered peripheral region of the planar structure, which is configured along an edge oriented in the cross-machine direction, is post-perforated here. It is furthermore conceivable that the at least one calendered peripheral region of the planar structure, which is configured along an edge oriented in the machine direction, is not post-perforated.

Preferably, in the calendered peripheral regions the MD yarns may be welded to the CMD yarns, while maintaining the yarn shape at least in portions.

Advantageously, the calendered peripheral regions in terms of thickness in relation to the original thickness of the planar textile structure, i.e. the non-calendered state of thickness may be reduced by calendering by a proportion of 5 to 50%, preferably by 10 to 30%.

The permeability in the calendered peripheral regions in relation to the permeability of the planar structure outside the calendered peripheral region or regions, respectively, may be reduced by calendering by 5 to 100%, preferably by 30 to 100%.

Preferably, the reduction in permeability in the calendered peripheral regions which are configured on the edges oriented in the machine direction can be greater than in the peripheral regions which are configured along the edges oriented in the cross-machine direction, since permeability in the region of a seam to be applied should expediently be substantially that of the permeability of the planar structure outside the calendered peripheral region or regions, respectively. Consequently, the permeability in the calendered peripheral regions which are configured along the edges oriented in the cross-machine direction advantageously deviates by at maximum 20%, preferably at maximum 10%, from the permeability of the planar structure outside the calendered peripheral region or regions, respectively.

According to one preferred embodiment of the invention, the width of the calendered peripheral regions may be 5 to 50 mm.

Advantageously, the extraction force which is required for extracting yarns oriented in the cross-machine direction in a calendered peripheral region is increased by at least 10% in relation to the extraction force for yarns oriented in the cross-machine direction of the same planar structure having non-calendered peripheral regions. The planar structure in the edges oriented in the machine direction is thus best protected against unraveling, while secure stitching even in the case of load-bearing seam elements is possible on the edges oriented in the cross-machine direction.

According to advantageous aspects of the invention, calendering may be performed unilaterally or bilaterally on a side which faces the fibrous web and/or on a side which faces the machine.

Advantageously, the seam elements in the form of seam loops may be configured on at least one of the edges oriented in the cross-machine direction, said loops being creatable by reverse interweaving at least some of the yarns oriented in the machine direction with the planar structure, and at least some reverse-interwoven portions of at least some of the MD yarns are welded to CMD yarns and/or to MD yarns in the calendered peripheral region of the at least one CMD-oriented edge.

As an alternative thereto, the seam elements may be configured in the form of helices or other suitable structures which are independent of the planar textile structure and which are releasably or non-releasably disposed on at least one calendered peripheral region of one of the edges oriented in the cross-machine direction. In this context, seam elements in the form of a zip fastener or of hooks are conceivable, for example. However, it is also conceivable for a seam element such as is described in applications WO2010/121360, WO2013/086609,WO2013/023272, WO2011/127594, WO2014/075170, or WO11069258, for example, to be used.

Particularly preferably, the seam elements having the planar textile structure may be non-releasably disposed on the at least one calendered peripheral region by adhesive bonding and/or stitching and/or welding.

According to one particularly preferred aspect of the invention, on account of the welding of the yarns by way of calendering of the calendered peripheral regions oriented in the cross-machine direction, the yarns oriented in the cross-machine direction may be loadbearing. This has the advantage that it is not necessary for seam loops to be configured for stitching on yarns oriented in the machine direction. Rather, the seam may be designed in a very effective manner in terms of durability and low marking tendency by securely anchoring separate seam elements.

Advantageously, on the at least one calendered peripheral region of the edge oriented in the cross-machine direction the thickness of the planar structure in relation to outside the peripheral region may be reduced, on account of which when viewed in the thickness direction of the planar structure, the upper side and/or lower side of the planar structure in the calendered peripheral region is recessed in relation to outside the calendered peripheral region, and the seam elements is disposed on the recessed side of the upper side and/or lower side.

According to one advantageous aspect of the invention, the clothing may be interconnectable by mutual interleaving of the seam elements on the edges oriented in the cross-machine direction and by inserting at least one pintle in a duct which has been formed by the interleaved seam elements. On account thereof, the clothing may be installed in the machine and removed therefrom in a simple and rapid manner, and without complex constructive measures.

The yarns forming the planar structure may be preferably configured as monofilaments or multifilaments.

According to one advantages aspect of the invention, the method may be carried out by means of a device for introducing energy, in particular by means of a rotating disk-shaped ultrasonic horn or of a hot wedge.

As a further method step, surface calendering of the peripheral regions which are configured bilaterally so as to adjoin the cutting edges may be performed, said further method step being carried out simultaneously with the other method steps.

Preferably, the further method step may be carried out by means of an additional device for introducing energy, which is guided in a parallel manner, in particular by means of an additional ultrasonic horn which is guided in a parallel manner or of a hot wedge which is a guided in parallel manner.

The invention will be explained in more detail in the following with reference to the drawing by means of a preferred exemplary embodiment and without limiting the general concept. In the drawing:

BRIEF DESCRIPTION OF THE DRAWING

The FIGURE shows a highly schematic illustration of a clothing configured according to the invention, in a perspective illustration.

A clothing 1 which may be used in particular as a drying wire in a machine for producing a fibrous web, such as a paper web or cardboard web, is illustrated in a schematic illustration in the FIGURE.

DESCRIPTION OF THE INVENTION

Woven drying wires as in the illustrated exemplary embodiment are often employed in the mentioned application. A further embodiment may be produced from wound helices which are mutually interleaved and interconnected by pintles. This embodiment is not the subject matter of the present invention.

In order to maintain clarity, only part of the drying wire face in the FIGURE is illustrated as a woven fabric from mutually intersecting yarns 2, 3. The yarns 2, 3 may be configured in a known manner as monofilaments or multifilaments in any cross-sectional shape from PET, PPS, PCTA, polyamides, Kevlar or similar materials which are suitable and known for the mentioned application.

The clothing 1 is configured in the form of a planar textile structure which two edges 4 which are oriented in a machine direction (hereunder referred to as MD) and two edges 5 which are oriented in a cross-machine direction (hereunder referred to as CMD).

In the machine, the clothing 1 is closable to form a closed loop by using seam elements 6. The seam elements 6 here may be configured so as to be integral with the clothing 1 or be provided as separate components which are embodied so as to be releasable or non-releasable on the clothing 1.

In the first case, some or all of the yarns 2 oriented in the MD are folded back and reverse interwoven, such that seam loops are configured at the end on one or both edges 5 in the CMD. Said seam loops a joinable so as to form an endless belt by mutual interleaving and subsequent insertion of a pintle 8 into the duct formed by the seam loops.

Alternatively, the seam elements 6 may also be configured in the form of separate components, for example in the form of helices which at one or both edges 5 may be connected in a suitable manner to the planar textile structure. The connection here may be designed to be releasable or non-releasable. Adhesive bonding, welding, stitching or similar may be used.

It is likewise possible for a hybrid form of the seam element 6 to be attached to the two edges 5, that is to say seam loops to one edge 5 and a separate component to the other edge 5.

According to the invention, the clothing 1 in the peripheral regions 7 which extend along the edges 4, 5 is treated by suitable measures, in particular by calendering, such that permeability and/or thickness of the clothing 1 is reduced in relation to the non-treated state.

The width of the peripheral regions 7 here may be 5 to 50 mm. The reduction in thickness is preferably 5 to 50%, particularly preferably 10 to 30% of the original thickness of the clothing 1.

A reduction in permeability of the clothing 1 by way of calendering is 5 to 100%, preferably between 30 and 100%. As can be appreciated, the reduction in permeability in the calendered peripheral regions 7 which are configured on edges 4 oriented in the machine direction is greater than in the calendered peripheral regions 7 which are configured along the edges 5 oriented in the cross-machine direction. The reason therefor is that there is no fibrous web running in the regions 7 oriented in the machine direction, and, correspondingly, the reduction in permeability here is not furthermore appreciable in terms of the quality of the final product. This in contrast to the calendered peripheral regions 7 oriented in the cross-machine direction, which are used for forming the seam. It is reasonable here to strive for permeability which substantially corresponds to that displayed by the remaining clothing 1, that is to say outside the calendered peripheral regions. In order for permeability to be set to a specific value, perforation to the desired extent may also be performed post-calendering and consequential compacting of the peripheral regions 7. This is particularly reasonable in the cross-machine direction if and when compacting has been very intense and permeability has been excessively restricted.

The peripheral regions 7 here may for example be calendered by introducing energy in the form of electromagnetic radiation, thermal radiation, or similar. The introduction of energy may be performed by way of an ultrasonic device, in particular by way of an ultrasonic horn, a laser device, a hot wedge device, or similar devices.

The yarns 2, 3 are interconnected on account of the introduction of energy, since said yarns 2, 3 are heated and softening of the material arises on account thereof, resulting in an improved form-fit of the yarns 2, 3, on the one hand. On the other hand, materially-integral bonding, that is to say fusing, of the yarns 2, 3 may also be performed to some extent. Here, yarns 2 oriented in the MD are welded to yarns 3 oriented in the CMD, and yarns 2, 3 oriented in the respective direction are welded to one another as well. Connecting the yarns here is performed under the proviso that the introduction of energy is kept sufficiently low so as not to lead to brittleness in the material. Furthermore, the selected cross-sectional shape of the yarns 2, 3 should be maintained post-calendering.

Calendering here may be performed unilaterally on that side of the clothing 1 that faces the fibrous web or the machine, as well as bilaterally on each of the edges 4, 5.

The mentioned measures are advantageous in many respects. On the one hand, an edge finish which prevents the yarns 2, 3 from being released from the planar textile structure and prevents the latter from being able to unravel may be achieved by way of the introduction of energy. In particular, it is possible for the extraction force which would be required for yarns 3 oriented in the cross-machine direction to be extracted from the woven fabric to be increased by at least 10% in relation to a clothing 1 having non-calendered peripheral regions 7. On account thereof, damage to the clothing 1 as well as to the machine may be prevented, and the service life of the clothing 1 may additionally be increased.

On the other hand, calendering of the edges 4 oriented in the machine direction permits structuring of the peripheral regions 7, on account of which it is possible for influence to be exerted on the aerodynamics of the clothing 1.

On account of calendering the edges 5 oriented in the CMD, it is moreover possible for the seam elements 6 to be configured in a more effective manner and to be fixed in a simpler and more reliable manner.

In the case of seam loops which have been created by reverse interweaving of yarns 2 in the planar textile structure, the length of the reverse interwoven yarns 2 may be reduced to a comparatively short distance, permitting faster production of the clothing 1. Moreover, stability of the seam loops is improved, since a connection between the yarns 2, 3 is established by calendering, reducing the risk of the reverse interwoven yarns 2 being extracted.

Calendering is also advantageous for fixing a separate seam element 6 to the extent that the calendered peripheral regions 7 are more stable and a separate seam element 6 may thus be fixed in a more reliable manner than to a non-calendered edge 5 of a clothing 1. Fraying of the yarns 3 oriented in the CMD in this instance is almost impossible, since there is a form-fitting and materially-integral connection between the yarns 2 and 3. On account of the interconnection between the yarns 2 and 3 it is possible for the yarns 3 oriented in the cross-machine direction to be designed in a load-bearing manner, without requiring seam loops to be configured. This load-bearing ability is enabled on account of welding by way of calendering. The tensile force acting on the clothing 1 in the state thereof when installed in the machine may thus be diverted to the yarns 3 oriented in the cross-machine direction. Consequently, separate seam elements 6 may be reliably fastened without the yarns 3 oriented in the cross-machine direction being ripped out under load.

Furthermore, the reduction in thickness of the clothing 1 in the region of the edges 5 is advantageous when the seam elements 6 are present as separate components and are fixed to the clothing 1. Components of this type require space in the thickness direction of the clothing 1. When the peripheral region 7 on account of calendering is thus no longer as thick as the remaining part of the clothing 1, that is to say as the non-calendered region, a seam element 6, for example a clip, may be fastened to the edge 5 without the clothing 1 becoming thicker on account thereof.

A further alternative embodiment lies in that a tape-shaped component is disposed as a seam element 6 either on the one or on the other side of the clothing 1. On account thereof, it may be prevented that undesirable noise emissions arise by way of the seam element 6 impacting on the drying cylinder of the paper machine or cardboard machine, for example. The marking tendency in the fibrous web as well as the abrasion tendency is likewise reduced on account thereof.

Production of the clothing 1 may be performed in a simple and time-saving manner at low complexity, since calendering may be performed simultaneously with the preparation of the clothing 1. The clothing 1 here is present as a flat-woven fabric which has to be tailored in terms of length and width to the position where it will be employed. The steps required to this end may be carried out by means of an ultrasonic horn, for example, in particular by means of a rotating disk-shaped ultrasonic horn, or by a hot wedge. The clothing 1 here is cut to the required dimensions (optionally including some allowance to compensate for shrinkage), and the edges 4, 5 are simultaneously trimmed, so that fraying or unraveling is no longer possible. The ends of the yarns 2, 3, or the yarns 3, 2 which in each case run transversely to the former, are welded to one another here. Calendering as has been described above may optionally be performed in a further operational step or particularly preferably be performed in the same operational step as cutting and trimming in that a second apparatus for introducing energy is guided in a parallel manner with the ultrasonic horn or the hot wedge, calendering the peripheral regions 7. The second apparatus may likewise be an ultrasonic horn, a hot wedge, a laser, or another suitable source for introducing energy.

The clothing 1 which has been prepared in this manner, on the edges 5 oriented in the CMD, may now be provided with seam elements 6 which, as described further above, may be configured as clips which are attachable to the edges 5 and may be welded to the edges 5, for example.

If and when the seam loops are to be created by reverse interweaving, it is reasonable for the seam loops to be formed first and for calendering for stabilizing the seam loops to be carried out subsequently.

The invention is not limited to the exemplary embodiment illustrated. In particular, a wide choice of weaving patterns and various materials for the yarns 2, 3 are conceivable and possible.

The invention claimed is:

1. A clothing for a machine for producing a fibrous web, the clothing comprising:

a planar textile structure formed of yarns which intersect substantially perpendicularly and which are substantially oriented in a machine direction and in a cross-machine direction;

said planar textile structure having two edges oriented in the machine direction and two edges oriented in the cross-machine direction;

seam elements configured to join said planar textile structure in the machine to form an endless belt, said seam elements being disposed at said edges that are oriented in the cross-machine direction and formed by, or connected to, said yarns that are oriented in the machine direction;

said planar textile structure having the characteristics of having been calendered by introducing energy only in peripheral regions which extend along said edges that are oriented in the machine direction and along said edges that are oriented in the machine cross direction, or by introducing energy only in the peripheral regions which extend along said edges that are oriented in the machine cross direction, wherein the yarns oriented in the machine direction are welded in the peripheral regions to the yarns oriented in the cross-machine direction and/or are form-fittingly interconnected at intersection points thereof, wherein those regions of said planar structure that have been calendered have a permeability that is reduced relative to those regions that have not been calendered and wherein the peripheral regions that extend along said edges that are oriented in the cross-machine direction have a permeability that is matched to the permeability of those regions that have not been calendered and the matched permeability is due to having been post-perforated while the peripheral regions that extend along said edges that are oriented in the machine direction have the reduced permeability due to having been calendered but not having been post-perforated.

2. The clothing according to claim 1, wherein, in the calendered peripheral regions, the yarns oriented in the machine direction are fused with the yarns oriented in the cross-machine direction and integral therewith.

3. The clothing according to claim 1, wherein, in the calendered peripheral regions, the yarns oriented in the machine direction are welded to the yarns oriented in the cross-machine direction, while maintaining a cross-sectional shape thereof.

4. The clothing according to claim 1, wherein a thickness of the calendered peripheral regions, relative to an original thickness in a non calendered state, is reduced by the calendering by a proportion of between 5% and 50%.

5. The clothing according to claim 1, wherein a permeability in the peripheral regions that have been calendered but not post-perforated, relative to a permeability of the planar structure outside the calendered peripheral regions, is reduced by the calendering by 5 to 100%.

6. The clothing according to claim 1, wherein a width of the calendered peripheral regions is between 5 mm and 50 mm.

7. The clothing according to claim 1, wherein an extraction force required for extracting yarns oriented in the cross-machine direction in relation to the planar textile structure having non-calendered peripheral regions is increased by at least 10%.

8. The clothing according to claim 1, wherein the calendering is effected unilaterally or bilaterally on a side configured to face a fibrous web and/or on a side configured to face the machine.

9. The clothing according to claim 1, wherein said seam elements are seam loops on at least one of said edges oriented in the cross-machine direction, said seam loops being formed by reverse interweaving of at least some of the yarns oriented in the machine direction with the planar structure, and at least some reverse-interwoven portions of at least some of the yarns oriented in the machine direction are welded to yarns oriented in the cross-machine direction and/or to yarns oriented in the machine direction in the calendered peripheral regions of the at least one edge oriented in the cross-machine direction.

10. The clothing according to claim 1, wherein said seam elements are helices or structures which are independent of said planar textile structure and which are releasably or non releasably disposed on at least one peripheral region of one of said edges oriented in the cross-machine direction.

11. The clothing according to claim 10, wherein said seam elements having the planar textile structure are non-releasably disposed on said at least one peripheral region by at least one process selected from the group consisting of adhesive bonding, stitching, welding, and interlocking.

12. The clothing according to claim 10, wherein, on account of the welding of the yarns by way of calendering of the peripheral regions oriented in the cross-machine direction, the yarns oriented in the cross-machine direction are load-bearing.

13. The clothing according to claim 10, wherein, on the at least one peripheral region of the edge oriented in the cross-machine direction, a thickness of the planar structure in relation to outside the peripheral region is reduced, on account of which, when viewed in the thickness direction of the planar structure, the upper side and/or lower side of the planar structure in the calendered peripheral region is recessed in relation to outside the calendered peripheral region, and the seam elements are disposed on the recessed side of the upper side and/or lower side.

14. The clothing according to claim 9, wherein the edges of the clothing are inter-connectable by mutual interleaving of said seam elements on the edges oriented in the cross-machine direction and by inserting at least one pintle in a duct formed by the interleaved seam elements.

15. The clothing according to claim 1, wherein said yarns forming said planar textile structure are configured as monofilaments or multi filaments.

16. A method for producing clothing according to claim 1, wherein the method comprises the following method steps:

i) providing a clothing with yarns oriented in the machine direction and yarns oriented in the cross-machine direction;

ii) cutting the clothing along a predefined cutting line in the machine direction and/or in the cross-machine direction;

iii) fusing ends of the yarns oriented in the machine direction and/or fusing ends of the yarns oriented in the cross-machine direction with the yarns oriented in the machine direction, so as to configure a smooth cutting edge.

17. The method according to claim 16, which comprises carrying out the method by way of a device for introducing energy selected from the group consisting of a rotating disk-shaped ultrasonic horn and of a hot wedge.

18. The method according to claim 16, which further comprises:

iv) surface calendering the peripheral regions which are configured bilaterally so as to adjoin the cutting edges; and thereby carrying out method step iv) simultaneously with method steps ii) and iii).

19. The method according to claim 18, wherein method step vi) is carried out by way of an additional device for introducing energy, which is guided in a parallel manner.

* * * * *